US009598983B2

(12) United States Patent
Suzuki

(10) Patent No.: US 9,598,983 B2
(45) Date of Patent: Mar. 21, 2017

(54) VARIABLE VALVE DEVICE FOR INTERNAL COMBUSTION ENGINE

(71) Applicant: TOYOTA JIDOSHA KABUSHIKI KAISHA, Toyota-shi (JP)

(72) Inventor: Takamasa Suzuki, Nissin (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/812,183

(22) Filed: Jul. 29, 2015

(65) Prior Publication Data

US 2016/0032788 A1 Feb. 4, 2016

(30) Foreign Application Priority Data

Jul. 31, 2014 (JP) ..... 2014-155908

(51) Int. Cl.

| | |
|---|---|
| ***F01L 1/34*** | (2006.01) |
| ***F01L 13/00*** | (2006.01) |
| *F01L 1/18* | (2006.01) |
| *F01L 1/24* | (2006.01) |
| *F01L 1/26* | (2006.01) |
| *F01L 1/053* | (2006.01) |

(52) U.S. Cl.

CPC ..... *F01L 1/34* (2013.01); *F01L 13/0063* (2013.01); *F01L 1/185* (2013.01); *F01L 1/2405* (2013.01); *F01L 1/267* (2013.01); *F01L 2001/0537* (2013.01); *F01L 2105/00* (2013.01); *F01L 2820/032* (2013.01)

(58) Field of Classification Search

CPC ... F01L 1/34; F01L 1/185; F01L 1/267; F01L 1/2405; F01L 2105/00; F01L 2820/032

USPC ..... 123/90.16, 90.18, 90.6

See application file for complete search history.

(56) References Cited

U.S. PATENT DOCUMENTS 7,793,625 B2 * 9/2010 Nakamura ..... F01L 1/3442 123/90.15

FOREIGN PATENT DOCUMENTS

| | | |
|---|---|---|
| JP | 2004-339951 | 12/2004 |
| JP | 2014-105587 | 6/2014 |
| JP | 2014-122552 A | 7/2014 |
| JP | 2014-152709 | 8/2014 |

* cited by examiner

*Primary Examiner* — Ching Chang

(74) *Attorney, Agent, or Firm* — Oblon, McClelland, Maier & Neustadt, L.L.P

(57) ABSTRACT

A cam of a variable valve device is provided with a change region, which is a region with which a roller abuts when a control shaft is displaced in an axial direction to change a maximum lift amount and in which a cam surface is inclined such that a diameter of the cam gradually increases toward one side in a rotation direction. The cam is provided with a retainer region with which the roller abuts when a position of the control shaft in the axial direction is retained to retain the maximum lift amount. An inclination angle of the cam surface in the retainer region is smaller as the maximum lift amount when the action member abuts with the retainer region is larger.

3 Claims, 8 Drawing Sheets

VARIABLE VALVE DEVICE FOR INTERNAL COMBUSTION ENGINE

INCORPORATION BY REFERENCE

The disclosure of Japanese Patent Application No. 2014-155908 filed on Jul. 31, 2014 including the specification, drawings and abstract is incorporated herein by reference in its entirety.

BACKGROUND OF THE INVENTION

1. Field of the Invention

The present invention relates to a variable valve device for an internal combustion engine, in which the variable valve device variably sets a maximum lift amount of an engine valve.

2. Description of Related Art

In recent years, a variable valve device for variably setting a maximum lift amount of an engine valve has been put to practical use in an internal combustion engine. For example, a variable valve device described in Japanese Patent Application Publication No. 2004-339951 (JP 2004-339951 A) includes: a control shaft that determines a maximum lift amount of an engine valve based on a position in an axial direction; a cam that changes the position of the shaft; and an actuator that rotates the cam.

Further, JP 2004-339951 A describes that a retainer region where a cam diameter does not change is provided in a cam surface of the cam as well as a change region where the cam diameter increases gradually toward one side in a rotation direction. The variable valve device described in JP 2004-339951 A has such a structure that an axial force is caused in the control shaft due to a reaction force of a valve spring of the engine valve, so that a roller, which is an operation member attached to a camshaft, is pressed against the cam surface.

In the variable valve device, when the maximum lift amount of the engine valve is changed, the cam is rotated so as to move the roller on the change region. Further, when the maximum lift amount of the engine valve is retained, a phase of the cam is controlled so that the roller is placed in the retainer region. In a state where the roller, which is an action member, is pressed against the retainer region of the cam, the axial force of the camshaft acts on a cam surface perpendicularly, so that a torque by the axial force of the control shaft is hard to act on the cam. Thus, the variable valve device described in JP 2004-339951 A restrains the cam from being rotated due to the axial force of the control shaft, thereby easily retaining the maximum lift amount.

In the meantime, an actuator in which a deceleration mechanism constituted by a plurality of gears in combination is attached to a motor can be employed as the actuator for driving the cam, so as to decelerate a rotation of the motor via the deceleration mechanism.

In a state where the roller, which is an action member, is pressed against the retainer region of the cam due to a reaction force of a valve spring of the engine valve, the axial force of the camshaft acts on the cam surface perpendicularly, as described above. Accordingly, a torque due to the axial force of the control shaft is hard to act on the cam. At this time, a gap is easily caused between the gears because of backlash between the gears constituting the deceleration mechanism, which may cause gear rattle noise along with vibrations of the cam due to fluctuations or the like of the axial force of the control shaft.

SUMMARY OF THE INVENTION

The present invention provides a variable valve device for an internal combustion engine in which the variable valve device can restrain occurrence of gear rattle noise in a deceleration mechanism in a state where an action member is pressed against a retainer region of a cam.

A variable valve device according to one aspect of the present invention is a variable valve device for an internal combustion engine, the variable valve device includes: a control shaft configured such that i) a maximum lift amount of an engine valve is determined according to a position of the control shaft in an axial direction and ii) an axial force acts on the control shaft due to a reaction force from a valve spring, the axial force being a force acting in the axial direction of the control shaft; an action member attached to the control shaft; a cam abutting with the action member, the cam being configured to displace the control shaft in the axial direction of the control shaft; and an actuator configured to pivot the cam by decelerating a rotation of a motor via a deceleration mechanism constituted by a plurality of gears in combination, the cam being provided with a change region and a retainer region, the change region being a region with which the action member abuts when the control shaft is displaced in the axial direction to change the maximum lift amount, and the change region being a region where a cam surface is inclined such that a diameter of the cam gradually increases toward one side in a rotation direction of the cam, the retainer region being a region with which the action member abuts when a position of the control shaft in the axial direction is retained to retain the maximum lift amount, and the retainer region being a region where the cam surface is inclined such that a torque is caused in the cam due to the axial force of the control shaft, the torque having a magnitude at which the gears constituting the deceleration mechanism are meshed with each other without being rotated.

According to the above configuration, in a state where the action member is pressed against the retainer region due to a reaction force from the valve spring, an axial force of the control shaft to act on the cam via the action member is split in the rotation direction of the cam, so that a torque is caused due to a component force of the axial force. An inclination angle of the cam surface in the retainer region is set so that a magnitude of the torque falls within a range in which the plurality of gears constituting the deceleration mechanism is meshed with each other and the gears are not rotated. Accordingly, in the variable valve device, while the maximum lift amount does not change depending on the torque, a state where the gears constituting the deceleration mechanism are engaged with each other is easily maintained, thereby restraining gear rattle noise due to backlash. Accordingly, in a state where the action member is pressed against the retainer region of the cam, it is possible to restrain occurrence of gear rattle noise of the deceleration mechanism.

As the retainer region, such a retainer region in which the cam surface is inclined such that the diameter of the cam gradually increases toward the one side in the rotation direction of the cam may be employed, for example. By employing such a configuration, while the cam is being rotated in one direction, the control shaft continues being displaced in the one direction even if the action member moves to pass the retainer region. Accordingly, behavior of the variable valve device is stabilized even when the maximum lift amount changes.

As the cam, a cam including a plurality of retainer regions in which respective maximum lift amounts to be retained are different from each other, and a plurality of change regions provided so as to connect the retainer regions to each other can be employed, for example. In the variable valve device including such a cam, the maximum lift amounts can be selectively changed by pivoting the cam to change the retainer regions with which the action member abuts. In view of this, in the variable valve device including such a cam, it is desirable that, an inclination angle of the cam surface in the retainer region is smaller as the maximum lift amount when the action member abuts with the retainer region is larger.

As the maximum lift amount is larger, that axial force of the control shaft which is caused due to a reaction force from a valve spring becomes larger. Accordingly, in the retainer region with which the action member abuts at a larger maximum lift amount, the axial force of the control shaft to act on the retainer region becomes larger.

In contrast, if the inclination angle of the cam surface is made smaller in the retainer region with which the action member abuts at a larger maximum lift amount like the above configuration, it is possible to relax occurrence of a difference in magnitude of the torque caused in the cam due to a difference in magnitude of the axial force acting on the cam.

In short, it is possible to restrain changes in the magnitude of the torque caused in the cam when the axial force of the control shaft changes. Accordingly, it is possible to easily maintain a state where the gears of the deceleration mechanism are engaged with each other, without changing the maximum lift amount.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
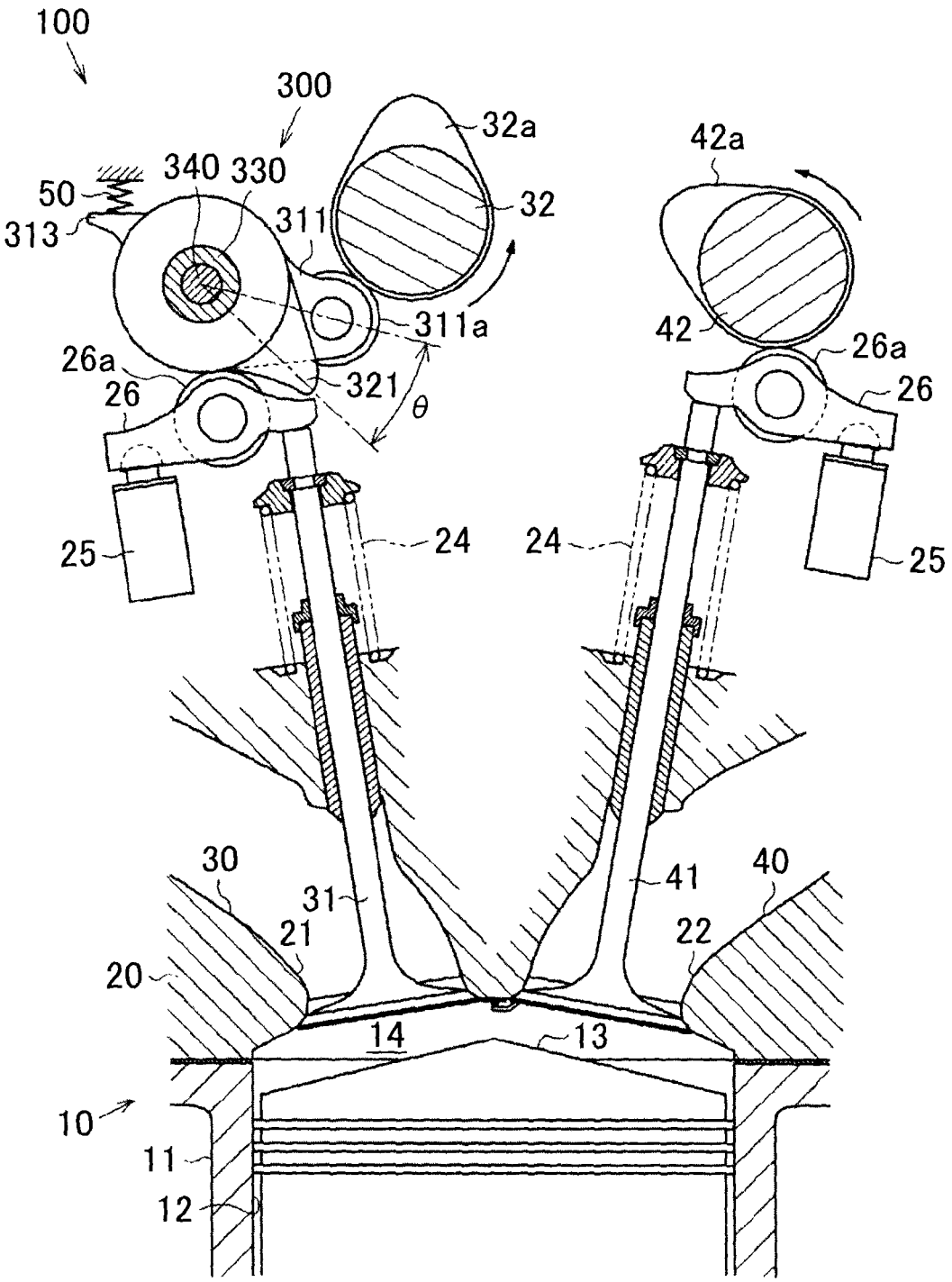
FIG. 1 is a sectional view illustrating a structure around a cylinder head of an internal combustion engine to which one embodiment of a variable valve device is applied.

One embodiment of a variable valve device for an internal combustion engine is described below with reference to FIGS. 1 to 7. As illustrated in FIG. 1, an internal combustion engine 10 includes a cylinder block 11 and a cylinder head 20 provided on the cylinder block 11. Cylindrical cylinders 12 according to the number of cylinders are formed inside the cylinder block 11. A piston 13 is accommodated in each of the cylinders 12 in a slidable manner. The cylinder head 20 is assembled to an upper side of the cylinder block 11, and a combustion chamber 14 is formed to be sectioned by an inner peripheral surface of the cylinder 12, a top face of the piston 13, and a bottom face of the cylinder head 20.

The cylinder head 20 is provided with an inlet port 21 communicating with an intake passage 30 and the combustion chamber 14, and an exhaust port 22 communicating with an exhaust passage 40 and the combustion chamber 14. The inlet port 21 is provided with an intake valve 31 as an engine valve for communicating the combustion chamber 14 with the inlet port 21 and disconnecting the combustion chamber 14 from the inlet port 21. The exhaust port 22 is provided with an exhaust valve 41 as an engine valve for communicating the combustion chamber 14 with the exhaust port 22 and disconnecting the combustion chamber 14 from the exhaust port 22. These valves 31, 41 are biased by valve springs 24 in a valve closing direction.

A lash adjuster 25 is provided inside the cylinder head 20 so as to correspond to each of the valves 31, 41. A rocker arm 26 is provided between the lash adjuster 25 and the each of the valves 31, 41. One end of the rocker arm 26 is supported by the lash adjuster 25, and the other end thereof abuts with an end part of the each of the valves 31, 41.

Further, an intake camshaft 32 and an exhaust camshaft 42 for driving the valves 31, 41, respectively, are rotatably supported in the cylinder head 20. An intake cam 32*a* is formed in the intake camshaft 32, and an exhaust cam 42*a* is formed in the exhaust camshaft 42. A roller 26*a* of the rocker arm 26 abutting with the exhaust valve 41 abuts with an outer peripheral surface of the exhaust cam 42*a*. Hereby, when the exhaust camshaft 42 rotates during an engine operation, the rocker arm 26 swings due to action of the exhaust cam 42*a*, with a part supported by the lash adjuster 25 being taken as a fulcrum. Due to the swing of the rocker arm 26, the exhaust valve 41 is opened and closed.

In the meantime, a variable mechanism portion 300 for changing valve characteristics of the intake valve 31 is provided between the rocker arm 26 abutting with the intake valve 31 and the intake cam 32*a*, and the variable mechanism portion 300 is provided for each cylinder. The variable mechanism portion 300 constitutes part of the variable valve device 100, and includes an input arm 311 and an output arm 321. The input arm 311 and the output arm 321 are swingably supported around a support pipe 330 fixed to the cylinder head 20. The rocker arm 26 is biased toward an output-arm-321 side by a biasing force of the valve spring 24, so that a roller 26*a* provided in an intermediate part of the rocker arm 26 abuts with an outer peripheral surface of the output arm 321.

Further, a projection 313 is provided on an outer peripheral surface of the variable mechanism portion 300, and a biasing force of a spring 50 fixed inside the cylinder head 20 acts on the projection 313. Due to the biasing force of the spring 50, a roller 311*a* provided in a tip end of the input arm 311 continuously abuts with an outer peripheral surface of the intake cam 32*a*. Hereby, when the intake camshaft 32 rotates during an engine operation, the variable mechanism portion 300 swings around the support pipe 330 due to action of the intake cam 32*a*. Then, the rocker arm 26 is pressed by the output arm 321, so that the rocker arm 26 swings with a part supported by the lash adjuster 25 being taken as a fulcrum. Due to the swing of the rocker arm 26, the intake valve 31 is opened and closed.

A control shaft 340 movable along an axial direction of the support pipe 330 is inserted into the support pipe 330. The variable mechanism portion 300 displaces the control shaft 340 in the axial direction, so as to change a relative phase difference between the input arm 311 and the output arm 321 around the support pipe 330, namely, an angle θ shown in FIG. 1.

Figure 2:
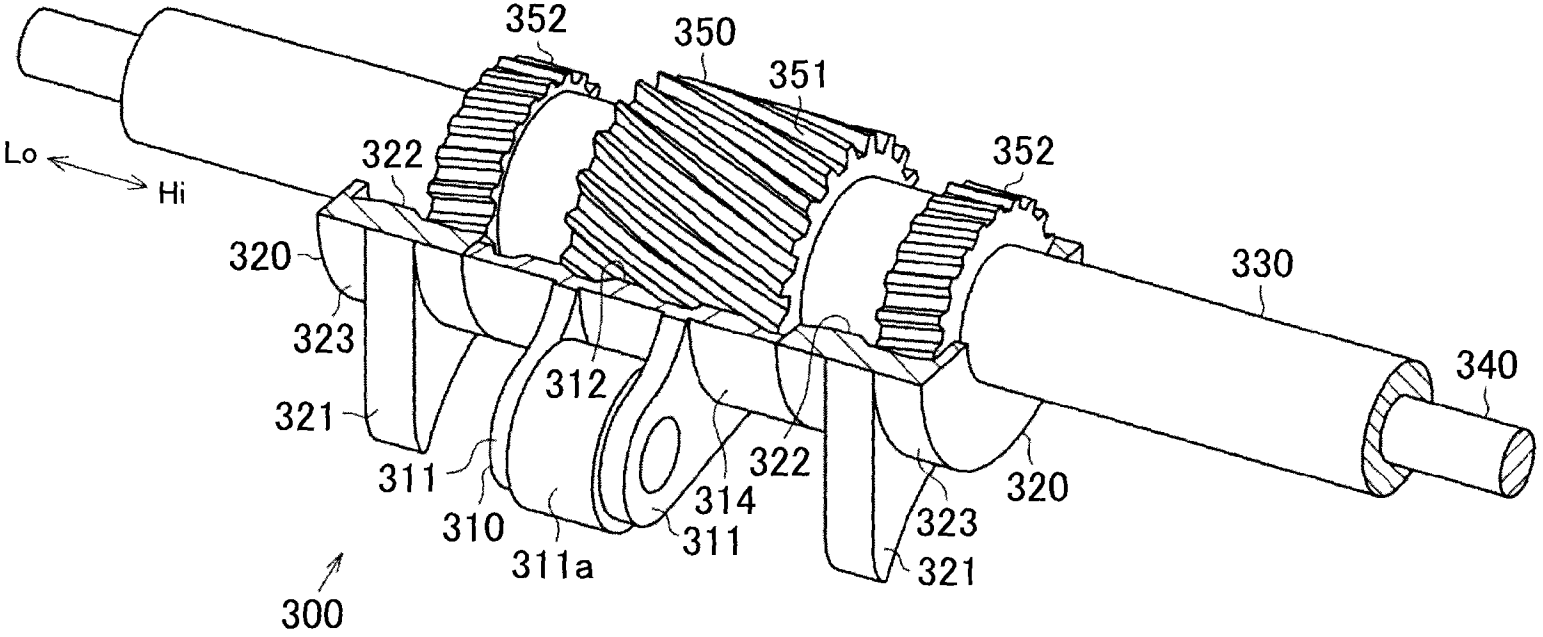
FIG. 2 is a cutaway perspective view of a variable mechanism portion.

Referring now to FIG. 2, a configuration of the variable mechanism portion 300 is described below further in detail. As illustrated in FIG. 2, output portions 320 are disposed in the variable mechanism portion 300 across an input portion 310 so that the output portions 320 are placed at both sides thereof. Respective housings 314, 323 of the input portion 310 and the output portions 320 are each formed in a hollow cylinder shape, and the support pipe 330 is passed therethrough.

Helical splines 312 are formed on an inner periphery of the housing 314 of the input portion 310. In the meantime, helical splines 322 with flank lines along an inclination direction opposite to the helical splines 312 of the input portion 310 are formed on an inner periphery of the housing 323 of each of the output portions 320.

A slider gear 350 is disposed in a consecutive internal space formed by respective housings 314, 323 of the input portion 310 and two output portions 320. The slider gear 350 is formed in a hollow cylindrical shape, and is disposed on an outer peripheral surface of the support pipe 330 in a reciprocating manner along the axial direction of the support pipe 330 and in a relatively rotatable manner around an axis of the support pipe 330.

Helical splines 351 meshed with the helical splines 312 of the input portion 310 are formed on an outer peripheral surface of an axially central part of the slider gear 350. In the meantime, helical splines 352 meshed with the helical splines 322 of the output portions 320 are formed on outer peripheral surfaces of both axially end parts of the slider gear 350.

A control shaft 340 movable along the axial direction of the support pipe 330 is provided inside the support pipe 330. The support pipe 330 is provided with a through hole, so that the control shaft 340 is engaged with the slider gear 350 with a pin via the through hole. Since the pin is engaged with a groove provided on an inner peripheral surface of the slider gear 350, the slider gear 350 can pivot relative to the support pipe 330 and the control shaft 340, and can move along the axial direction on the support pipe 330 in association with axial movement of the control shaft 340.

In the variable mechanism portion 300 configured as such, when the control shaft 340 moves in the axial direction, the slider gear 350 also moves in the axial direction in association with the movement of the control shaft 340. The helical splines 351, 352 formed on the outer peripheral surface of the slider gear 350 have flank lines along different inclination directions. Because of this, when the slider gear 350 moves in the axial direction, the input portion 310 and the output portions 320 meshed with the slider gear 350 via the helical splines 312, 322 pivot in opposite directions. As a result, a relative phase difference between the input arm 311 and the output arms 321 is changed, so that a maximum lift amount and a valve opening period, which are valve characteristics of the intake valve 31, are changed.

More specifically, when the control shaft 340 is moved in a direction indicated by an arrow Hi in FIG. 2, the slider gear 350 are also moved in the same direction together with the control shaft 340. In association with this, the relative phase difference between the input arm 311 and the output arm 321, that is, the angle θ shown in FIG. 1 becomes large, so that a maximum lift amount VL and a valve opening period of the intake valve 31 increase, thereby increasing an air volume (an intake-air amount) to be taken in the combustion chamber 14. In the meantime, when the control shaft 340 is moved in a direction indicated by an arrow Lo in FIG. 2, the slider gear 350 is also moved in the same direction together with the control shaft 340, so that the relative phase difference between the input arm 311 and the output arm 321, that is, the angle θ shown in FIG. 1 becomes small. Hereby, the maximum lift amount VL and the valve opening period of the intake valve 31 decrease, so that the intake-air amount decreases.

That is, in moving directions of the control shaft 340, a direction indicated by the arrow Hi is a direction where the maximum lift amount increases, and a direction indicated by the arrow Lo is a direction where the maximum lift amount decreases.

Note that an axial force in the direction of the arrow Lo acts on the control shaft 340 due to a reaction force from the valve spring 24 that biases the intake valve 31. Next will be described a configuration of a driving portion that moves the control shaft 340 in the axial direction.

Figure 3:
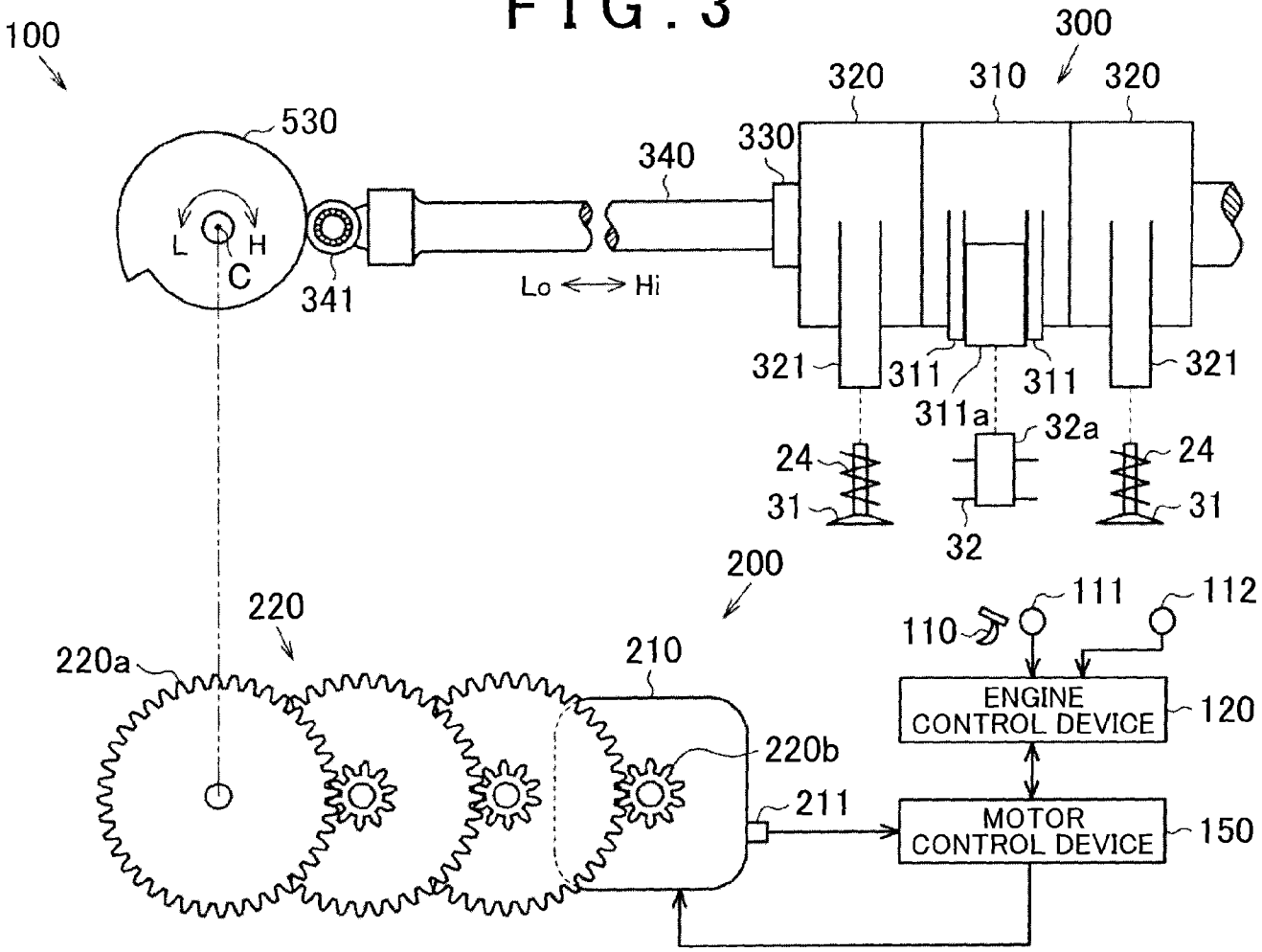
FIG. 3 is a schematic view of a driving portion of the variable valve device.

As illustrated in FIG. 3, the driving portion of the variable valve device 100 includes: a cam 530 with which a roller 341 serving as an action member attached to an end part of the control shaft 340 abuts; and an actuator 200 that pivots the cam 530 by decelerating a rotation of an electrically-driven motor 210 via a deceleration mechanism 220. The motor 210 is provided with a rotation angle sensor 211 for detecting a rotation angle of the motor 210.

The deceleration mechanism 220 is constituted by a plurality of gears provided in combination. As described above, since the axial force in the direction of the arrow Lo acts on the control shaft, the roller 341 is being pressed against a cam surface of the cam 530. Note that a gear 220*a* placed at an end, among the plurality of gears constituting the deceleration mechanism 220, is connected to the cam 530.

When the motor 210 is driven, a gear 220*b* directly connected to the motor 210, among the plurality of gears constituting the deceleration mechanism 220, pivots, so as to pivot each of the gears constituting the deceleration mechanism 220, and thus, the cam 530 pivots. As a result, that part of the cam surface which abuts with the roller 341 changes, so that the control shaft 340 is displaced in the axial direction along with changes in a cam diameter (a radius from a rotation center C of the cam 530 to the cam surface) of that part of the cam surface which abuts with the roller 341.

A motor control device 150 for controlling driving of the motor 210 is connected to the motor 210. A rotation angle of the motor 210 is controlled in response to a driving signal from the motor control device 150. The motor control device 150 is connected to an engine control device 120 for controlling an operation state of the internal combustion engine 10.

An accelerator operation amount ACCP, which is an operation amount of an accelerator pedal 110 and detected by an accelerator operation amount sensor 111, a crank angle detected by a crank angle sensor 112, and the like are input to the engine control device 120. The engine control device 120 calculates a request intake-air amount based on an engine rotation speed NE and the like calculated from the accelerator operation amount ACCP and the crank angle, for example, and calculates a necessary maximum lift amount of the intake valve 31 to obtain an intake-air amount balanced with the request intake-air amount. The maximum lift amount thus calculated is set as a target lift amount VLp. When the target lift amount VLp is set as such, a target rotational phase Kp of the cam 530 corresponding to the target lift amount VLp is calculated in the motor control device 150, and a rotation angle of the motor 210 is controlled so that a rotational phase of the cam 530 accords with the target rotational phase Kp thus calculated.

Further, the motor control device 150 calculates an actual rotational phase of the cam 530 from that rotation angle of the motor 210 which is detected by the rotation angle sensor 211, and then calculates a current value of the maximum lift amount VL from the rotational phase K thus calculated. Then, the motor control device 150 transmits the calculated current value of the maximum lift amount VL to the engine control device 120.

Figure 4:
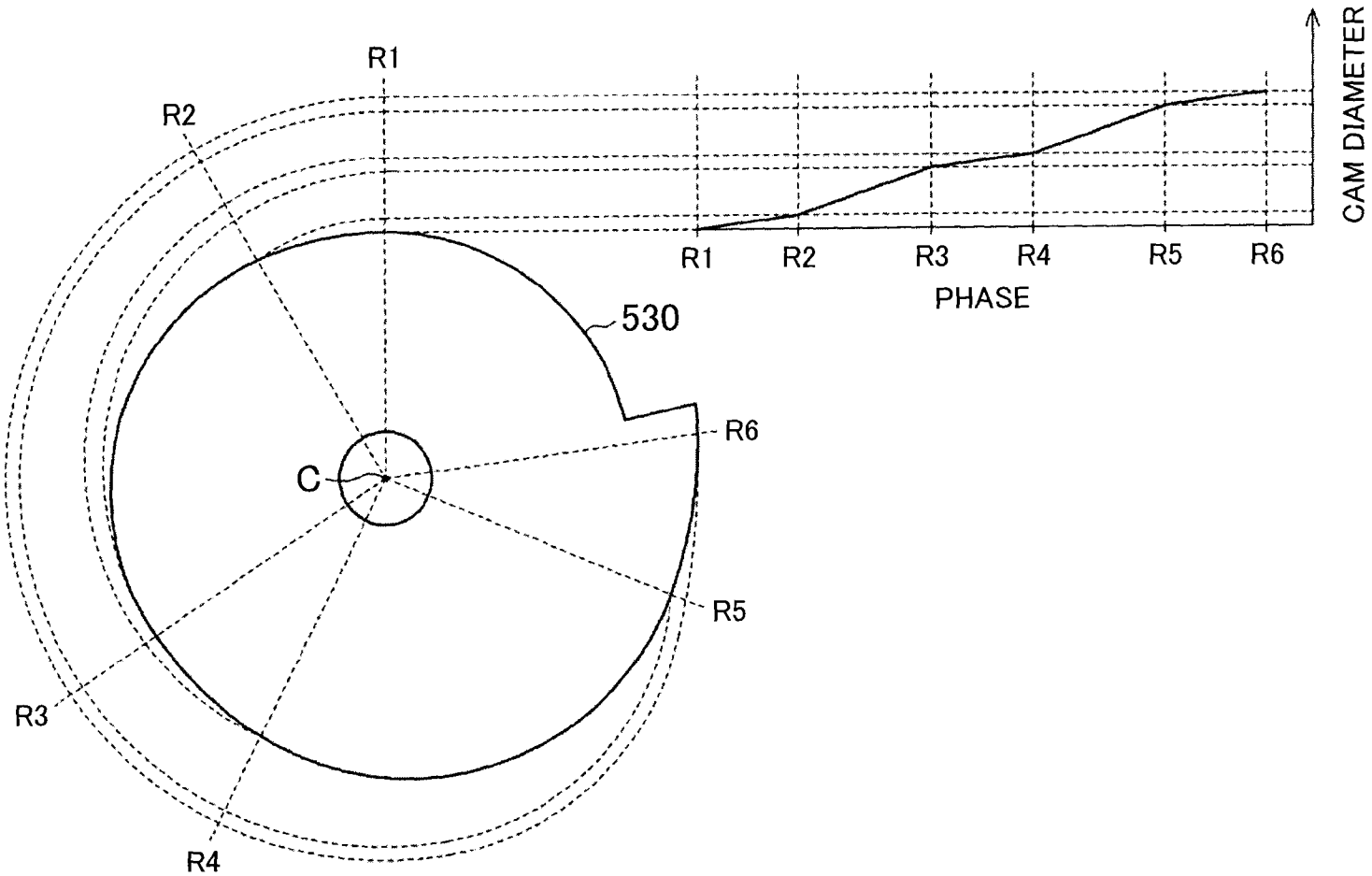
FIG. 4 is a view illustrating a cam profile of a cam provided in a variable valve device.
Figure 5:
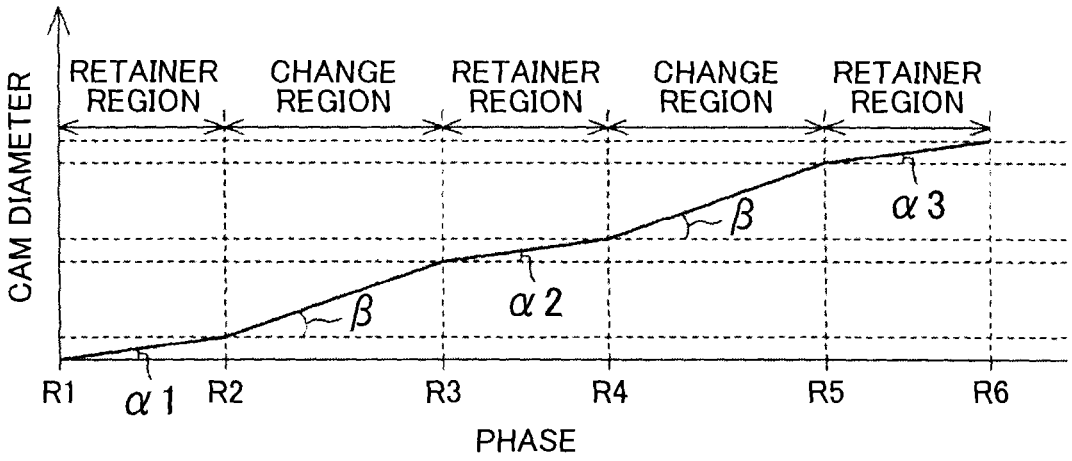
FIG. 5 is a graph illustrating a relationship between a phase and a diameter on a cam surface.

Referring now to FIGS. 4 and 5, a setting mode of a cam profile of the cam 530 to displace the control shaft 340 is described in detail. Note that FIGS. 4 and 5 schematically illustrate a setting mode of the cam profile of the cam 530 in the present embodiment. For purposes of this description, a diameter change rate or the like relative to a change in phase is illustrated in an exaggerated manner as compared with an actual rate or the like.

As illustrated in FIG. 4, in the cam 530, a region from a first phase R1 to a sixth phase R6 serves as a control region used to control the maximum lift amount VL. That target rotational phase Kp of the cam 530 which corresponds to the target lift amount VLp is set so that a position where the roller 341 abuts changes within the control region by controlling a rotational phase of the cam 530.

In the cam surface in the control region, change regions with a shape having a curved surface and inclined so that its diameter gradually increases toward one side in a rotation direction of the cam 530 (from a second phase R2 to a third phase R3 and from a fourth phase R4 to a fifth phase R5) are provided. Hereby, in these change regions, the diameter of the cam 530 changes linearly along with a phase change. Further, such change regions are regions where the roller 341 abuts when the control shaft 340 is displaced in the axial direction so as to change the maximum lift amount VL.

Further, in the cam surface in the control region, retainer regions with a shape having a curved surface and inclined so that the diameter gradually increases toward one side in the rotation direction of the cam 530 at an inclination smaller than an inclination of the cam diameter in the change regions (from a first phase R1 to the second phase R2, from the third phase R3 to the fourth phase R4, and the fifth phase R5 to a sixth phase R6) are also provided. Hereby, in these retainer regions, the diameter of the cam 530 changes linearly, along with a phase change, at a change rate smaller than a change rate of the diameter in the change regions. Further, such retainer regions are regions where the roller 341 abuts at the time when a position of the control shaft 340 in the axial direction is retained so as to retain the maximum lift amount VL.

Note that, in the following description, in regard to the rotation direction of the cam 530, a direction in which a position where the roller 341 abuts changes in order of the first phase R1, the second phase R2, and the third phase R3 (a direction where the cam 530 is rotated right-handedly (clockwise) in FIG. 4) is defined as a direction where a rotational phase, which is one side of the rotation direction of the cam 530, is increased.

Since the cam 530 has the above cam profile, when a rotational phase of the cam 530 changes so as to change the position where the roller 341 abuts within the first phase R1 to the sixth phase R6, the maximum lift amount VL of the intake valve 31 changes as follows.

In a case where the rotational phase of the cam 530 is changed so as to change the position where the roller 341 abuts within a zone between the first phase R1 and the second phase R2, when the rotational phase of the cam 530 is increased, a diameter of that part of the cam 530 which abuts with the roller 341 gradually increases, as illustrated in FIG. 5. However, in this zone, a change rate $\alpha 1$ of the diameter of the cam 530 is set to be extremely small, so the control shaft 340 is hardly displaced at this time and the maximum lift amount VL hardly changes. On that account, in a case where the roller 341 is placed in the zone between the first phase R1 and the second phase R2, the maximum lift amount VL is retained at a first lift amount VL1. Note that the first lift amount VL1 is a minimum value of the maximum lift amount VL.

In a case where the rotational phase of the cam 530 is changed so as to change the position where the roller 341 abuts within a zone between the second phase R2 and the third phase R3, when the rotational phase of the cam 530 is increased, the diameter of that part of the cam 530 which abuts with the roller 341 gradually increases at a change rate $\beta$, which is larger than the change rate $\alpha 1$. At this time, the control shaft 340 is gradually displaced in a direction where the maximum lift amount VL increases, so that the maximum lift amount VL gradually increases from the first lift amount VL1.

In a case where the rotational phase of the cam 530 is changed so as to change the position where the roller 341 abuts within a zone between the third phase R3 and the fourth phase R4, when the rotational phase of the cam 530 is increased, the diameter of that part of the cam 530 which abuts the roller 341 gradually increases. However, a change rate $\alpha 2$ of the diameter of the cam 530 is also set to be extremely small, so the control shaft 340 is hardly displaced at this time and the maximum lift amount VL hardly changes. On that account, in a case where the roller 341 is placed in the zone between the third phase R3 and the fourth phase R4, the maximum lift amount VL is retained at a second lift amount VL2, which is larger than the first lift amount VL1.

In a case where the rotational phase of the cam 530 is changed so as to change the position where the roller 341 abuts within a zone between the fourth phase R4 and the fifth phase R5, when the rotational phase of the cam 530 is increased, the diameter of that part of the cam 530 which abuts with the roller 341 gradually increases at the change rate $\beta$. At this time, the control shaft 340 is gradually displaced in a direction where the maximum lift amount VL increases, so that the maximum lift amount VL gradually increases from the second lift amount VL2.

Further, in a case where the rotational phase of the cam 530 is changed so as to change the position where the roller 341 abuts within a zone between the fifth phase R5 and the sixth phase R6, when the rotational phase of the cam 530 is increased, the diameter of that part of the cam 530 which abuts with the roller 341 gradually increases. However, a change rate $\alpha 3$ of the diameter of the cam 530 in this zone is also set to be extremely small, so the control shaft 340 is hardly displaced at this time and the maximum lift amount VL hardly changes. On that account, in a case where the roller 341 is placed in the zone between the fifth phase R5 and the sixth phase R6, the maximum lift amount VL is retained at a third lift amount VL3, which is larger than the second lift amount VL2. Note that the third lift amount VL3 is a maximum value of the maximum lift amount VL.

Note that the maximum lift amount VL of the intake valve 31 increases in order of the first lift amount VL1, the second amount of lift VL2, and the third lift amount VL3, a valve opening timing of the intake valve 31 changes in an advance direction, and a valve closing timing changes in a delay direction, so that a valve opening period of the intake valve 31 becomes long.

In the variable valve device according to the present embodiment, any of the first lift amount VL1, the second lift amount VL2, and the third lift amount VL3 is selected as the target lift amount VLp of the intake valve 31 according to an engine operation state. When the retainer region with which the roller 341 abuts is changed to another by pivoting the cam 530 according to the engine operation state, the maximum lift amount VL of the intake valve 31 to be retained is changed selectively at three stages. As such, the variable valve device according to the present embodiment is a multi-stage variable valve device that changes valve characteristics at multiple stages by selecting a valve characteristic from a plurality of valve characteristics set in advance.

Figure 6:
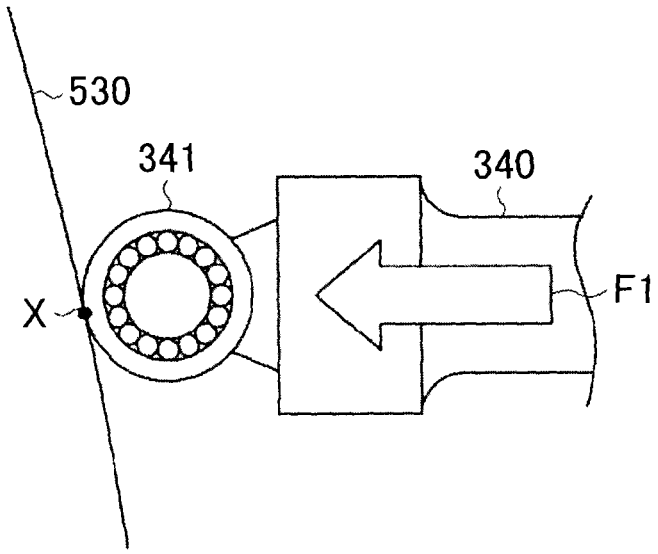
FIG. 6 is a schematic view illustrating a state where a roller abuts with the cam surface.
Figure 7:
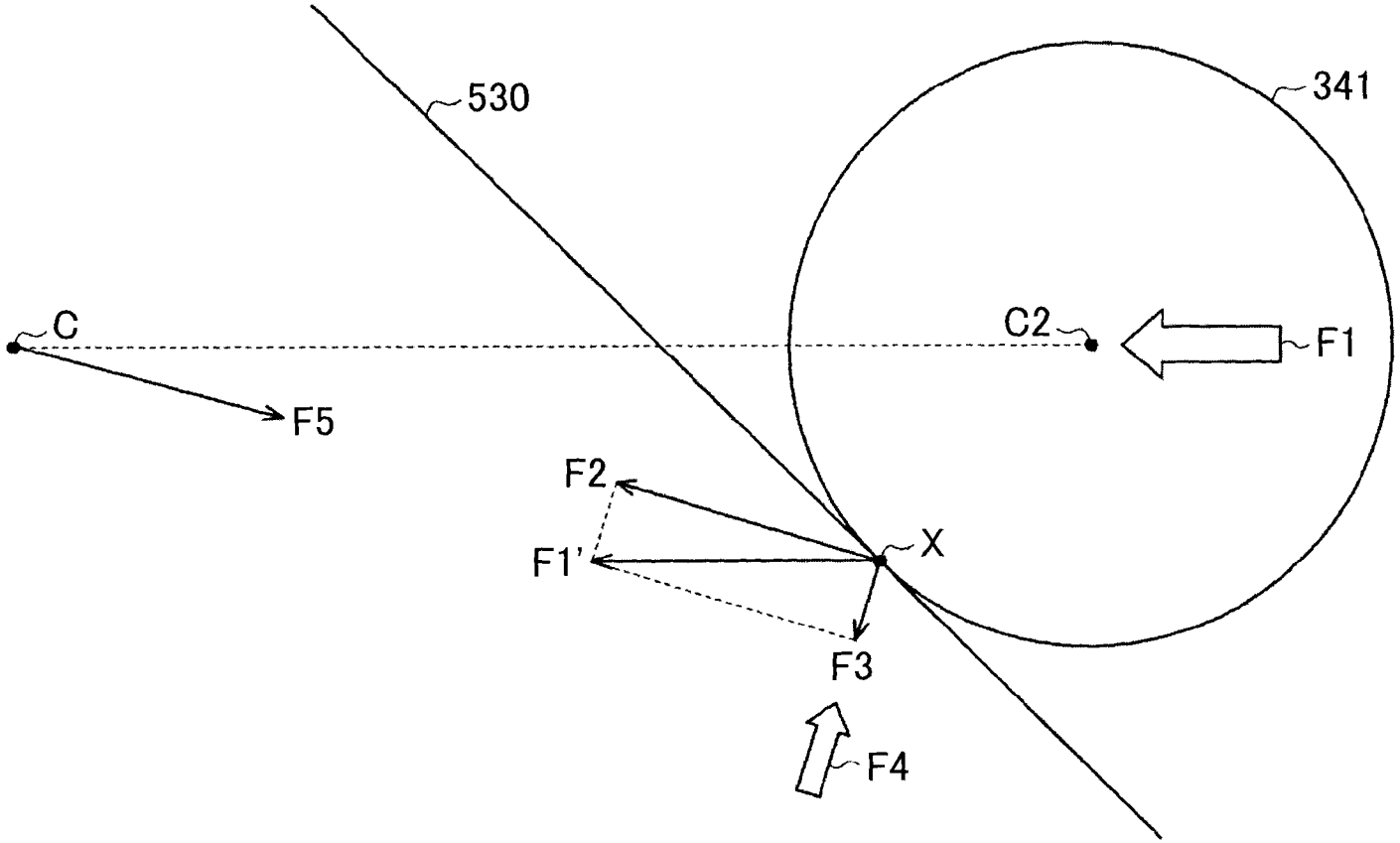
FIG. 7 is a schematic view to describe a force acting on the cam.

Referring now to FIGS. 6, 7, a setting mode of the inclination angle of the cam surface in each of the retainer regions is described further in detail. As illustrated in FIG. 6, an axial force F1 acts on the control shaft 340 due to a reaction force from the valve spring 24 that biases the intake valve 31. As described above, since the cam 530 is slightly inclined even in the retainer regions, in a case where the roller 341 abuts with any of the retainer regions in the cam 530 as illustrated in FIG. 6, a contact point X between the cam 530 and the roller 341 deviates from a rotation center C of the cam 530.

FIG. 7 schematically illustrates a relationship of a force acting on the cam 530 at this time. In FIG. 7, for purposes of this description, an inclination and the like of the cam surface of the cam 530 are exaggerated. As illustrated in FIG. 7, the contact point X between the cam 530 and the roller 341 is placed at a position deviating from a straight line connecting the rotation center C of the cam 530 with a rotation center C2 of the roller 341. Accordingly, a force F1' given to the cam 530 due to an axial force F1 input through the roller 341 can be split into a component force F2 in a direction toward the rotation center C of the cam 530 and a component force F3 in a direction perpendicular to the component force F2. The rotation center C of the cam 530 is supported and does not move, so the component force F2 in a direction toward the rotation center C of the cam 530 is offset by a reaction force F5 from the rotation center C of the cam 530. In the meantime, the component force F3 in the direction perpendicular to the component force F2 in the direction toward the rotation center C of the cam 530 acts as a torque to rotate the cam 530.

The inclination angle of the cam surface in each of the retainer regions is set so that the torque caused in the cam 530 due to the component force F3 falls within a range in which the plurality of gears constituting the deceleration mechanism 220 is meshed with each other and the gear 220*b* directly connected to the motor 210, among the gears constituting the deceleration mechanism 220, is not rotated. That is, herein, the inclination angle of the cam surface in each of the retainer region is set so that the torque caused in the cam 530 due to the component force F3 falls within a range in which the plurality of gears constituting the deceleration mechanism 220 is meshed with each other and the gears are not rotated. That is, in the zone between the first phase R1 and the second phase R2, the zone between the third phase R3 and the fourth phase R4, and the zone between the fifth phase R5 and the sixth phase R6, which constitute respective retainer regions, magnitudes of respective change rates $\alpha 1$, $\alpha 2$, $\alpha 3$ of the diameter of the cam 530 are set so that the torque falls within a range where the gears constituting the deceleration mechanism 220 are meshed with each other and the gear 220*b* is not rotated.

Note that, as the maximum lift amount VL is larger, that axial force F1 of the control shaft 340 which is caused due to the reaction force from the valve spring 24 becomes larger. Accordingly, in a retainer region with which the roller 341 abuts at the time when the maximum lift amount VL is larger, that axial force F1 of the control shaft 340 which acts on the retainer region becomes larger. That is, the axial force F1 of the control shaft 340 to act becomes larger in order of the zone between the first phase R1 and the second phase R2, the zone between the third phase R3 and the fourth phase R4, and the zone between the fifth phase R5 and the sixth phase R6.

In this regard, in the present embodiment, in a retainer region with which the roller 341 abuts at the time when the maximum lift amount VL is larger, the inclination angle of the cam surface of the cam 530 is made smaller. That is, in the variable valve device, the change rates $\alpha 1$, $\alpha 2$, $\alpha 3$ of the diameter of the cam 530 in respective zones become smaller in order of the zone between the first phase R1 and the second phase R2, the zone between the third phase R3 and the fourth phase R4, and the zone between the fifth phase R5 and the sixth phase R6 ($\alpha 1 > \alpha 2 > \alpha 3$).

Note that a magnitude of the inclination angle of the cam surface in each of the retainer regions is set so that a magnitude of the component force F3 to act on the cam 530 becomes at the same level even if a magnitude of that axial force F1 of the control shaft 340 which acts in each of the retainer regions is different.

Next will be described an operation of the present embodiment. Since the inclination angle of the cam surface in each of the retainer regions is extremely small, even if a torque is caused in the cam 530 due to the component force F3 in a state where the roller 341 is pressed against the retainer regions, a displacement amount of the control shaft 340 is retained, so that the maximum lift amount VL is retained.

Further, as illustrated in FIG. 7, since a torque is caused in the cam 530 due to the component force F3, gaps between the gears constituting the deceleration mechanism 220 disappear, so that a state where the gears are engaged with each other is easily maintained. Accordingly, even if the axial force F1 of the control shaft 340 fluctuates, a movement of the cam 530 is restrained by that friction force F4 of the gears which occurs due to the engagement of the gears of the deceleration mechanism 220.

According to the variable valve device 100 for the internal combustion engine 10, it is possible to yield the following effects. (1) The cam surface is inclined so as to provide the retainer regions so that a torque is caused in the cam 530 due to the axial force F1 of the control shaft 340 within a range in which the plurality of gears constituting the deceleration mechanism 220 is meshed with each other and the gears are not rotated. Because of this, the maximum lift amount VL does not change depending on a torque caused in the cam 530 due to the axial force F1 of the control shaft 340. Accordingly, when the maximum lift amount VL is retained, it is not necessary to drive the motor 210, thereby making it possible to restrain power consumption.

(2) When the roller 341 is pressed against the retainer region, a torque is caused in the cam 530 though the torque is small. Accordingly, a state where the gears constituting the deceleration mechanism 220 are engaged with each other is easily maintained, thereby restraining gear rattle noise due to backlash. Accordingly, in a state where the roller 341 is pressed against the retainer region of the cam 530, it is possible to restrain occurrence of gear rattle noise of the deceleration mechanism 220.

(3) In the retainer regions, the cam surface is inclined in the same direction as the inclination direction of the cam surface in the change regions, and the diameter increases gradually toward one side. Because of this, while the cam 530 is being rotated in one direction, the control shaft 340 continues being displaced in the one direction even if the roller 341 moves to pass the retainer region. Accordingly, behavior of the variable valve device 100 is stabilized even if the maximum lift amount VL changes.

(4) In a retainer region with which the roller 341 abuts at the time when the maximum lift amount VL is larger, the inclination angle of the cam surface is made smaller. Accordingly, it is possible to relax occurrence of a difference in magnitude of the torque caused in the cam 530 due to a difference in magnitude of the axial force F1 to act on the cam 530 between the retainer regions. In short, it is possible to restrain the magnitude of the torque caused in the cam 530 from changing due to changes in the axial force F 1 of the control shaft 340. Accordingly, it is possible to easily maintain a state where the gears of the deceleration mechanism 220 are engaged with each other, without changing the maximum lift amount VL.

Figure 8:
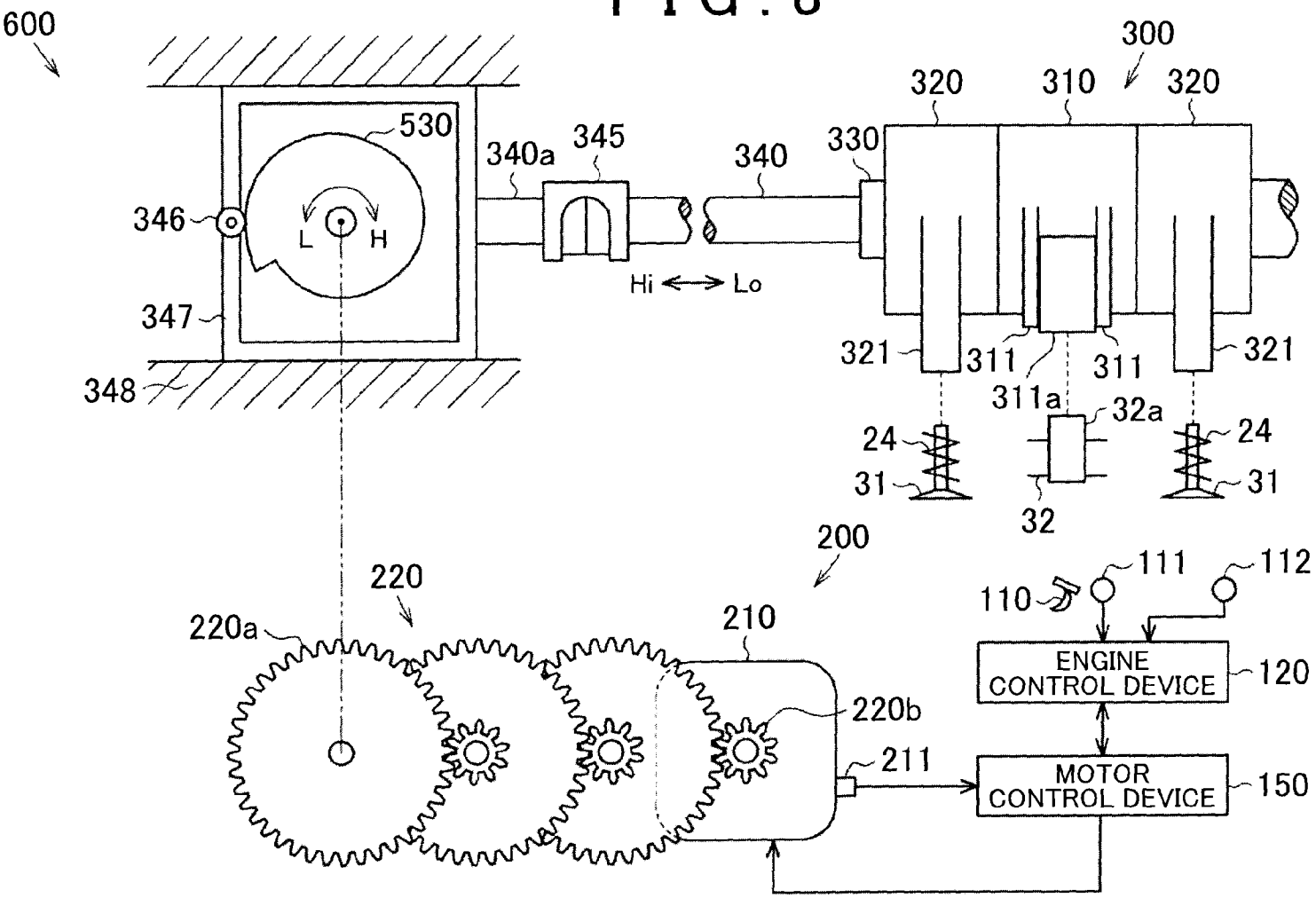
FIG. 8 is a schematic view of a driving portion of a variable valve device according to another embodiment.

Note that the above embodiment can be modified as follows. As illustrated in FIG. 8, a variable valve device 600 having a different disposition mode of a cam 530 and a control shaft 340 from the mode described in the above embodiment can be employed. Herein, inclination directions of flank lines of helical splines 312, 322, 351, 352 in a variable mechanism portion 300 are opposite to those in the above embodiment. Accordingly, in the variable mechanism portion 300 herein, a relationship between a moving direction of the control shaft 340 and changes in a maximum lift amount is reverse to the above embodiment. That is, in the variable mechanism portion 300 illustrated in FIG. 8, when the control shaft 340 is displaced in a direction of an arrow Lo in FIG. 8, the maximum lift amount decreases, and when the control shaft 340 is displaced in a direction of an arrow Hi in FIG. 8, the maximum lift amount increases.

The variable valve device 600 of this modification includes a holder 347 and a guide 348 for guiding movement of the holder 347. The holder 347 can reciprocate along the guide 348. A connection shaft 340*a* extending toward the control shaft 340 is attached to the holder 347. An end part of the control shaft 340 on a connection-shaft-340*a* side is connected to an end part of the connection shaft 340*a* via a connection portion 345. A cam 530 is placed inside the holder 347, and a roller 346 abutting with a cam surface of the cam 530 is rotatably attached to the holder 347. In this modification, the roller 346 functions as an action member attached to the control shaft 340 and biased in a direction where the roller 346 is pressed against the cam surface of the cam 530.

Figure 9:
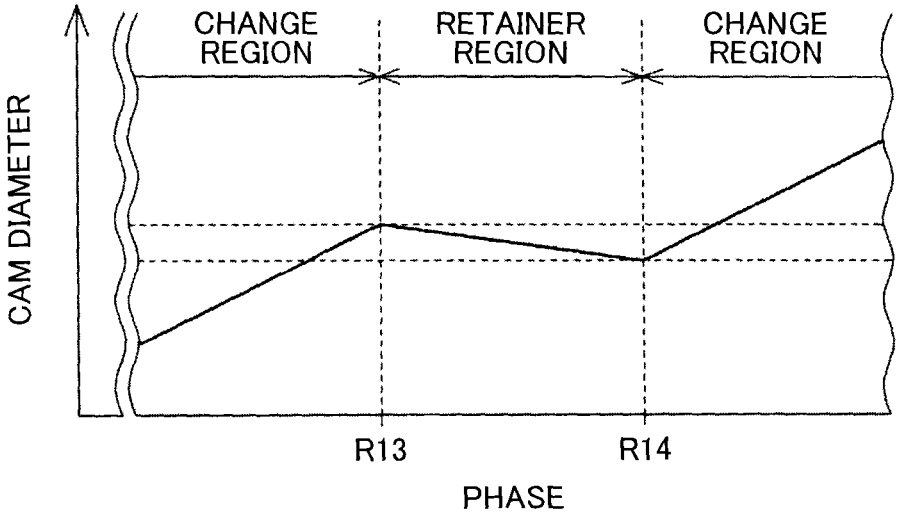
FIG. 9 is a graph illustrating a relationship between a phase and a diameter on a cam surface according to another embodiment.

Even in such variable valve device 600, by setting a cam profile similarly to the cam 530 of the above embodiment, it is possible to obtain the same effects as the above embodiment.—As illustrated in FIG. 9, a direction where the diameter of the cam 530 changes in change regions (exemplified as a zone before a phase R13 and a zone after a phase R14 in FIG. 9) may be different from a direction where the diameter of the cam 530 changes in a retainer region (exemplified as a zone between the phase R13 and the phase R14 in FIG. 9). Even in this case, the inclination angle of the cam surface in the retainer region is set so that, in a state where the roller 341 abuts with the retainer region, a magnitude of a torque due to a component force F2 acting on the cam 530 falls within a range in which the plurality of gears constituting the deceleration mechanism 220 is meshed with each other and the gears are not rotated. Even with such a configuration, it is possible to yield the same effects as the effects (1), (2), (4) obtained in the above embodiment.

Figure 10:
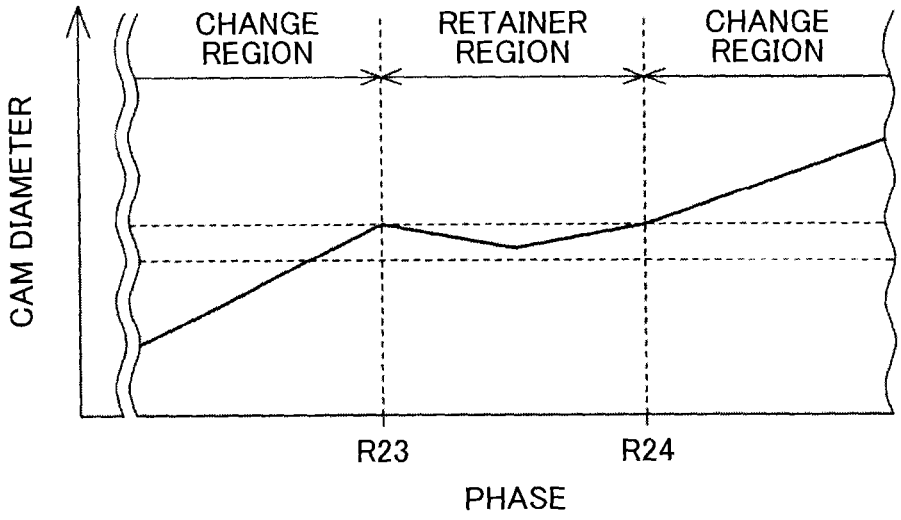
FIG. 10 is a graph illustrating a relationship between a phase and a diameter on a cam surface according to another embodiment.

As illustrated in FIG. 10, in a retainer region (exemplified as a zone between a phase R23 and a phase R24 in FIG. 9), the cam surface may be inclined so that the diameter gradually increases after the diameter gradually decreases toward one side in the rotation direction of the cam 530. Even in this case, an inclination angle of an inclined surface in each of the retainer regions is set so that, in a state where the roller 341 abuts with the retainer region, a magnitude of a torque due to the component force F2 acting on the cam 530 falls within a range in which the plurality of gears constituting the deceleration mechanism 220 is meshed with each other and the gears are not rotated. Even with such a configuration, it is possible to yield the same effects as the effects (1), (2), (4) obtained in the above embodiment.

A planar retainer region may be formed in the cam surface of the cam 530. In this modification, a change rate of the diameter of the cam 530 in a retainer region changes continuously according to a phase, so that the diameter of the cam 530 in the retainer region changes in a curved shape. Even in such a configuration, an inclination angle of the cam surface in the retainer region is set so that, in a state where the roller 341 abuts with the retainer region, a magnitude of a torque due to a component force F3 acting on the cam 530 falls within a range in which the plurality of gears constituting the deceleration mechanism 220 is meshed with each other and the gears are not rotated. Hereby, it is possible to yield the same effects as the effects (1), (2), (4) obtained in the above embodiment. Further, if the inclination angle of the cam surface is set so as to continuously increase, over the whole retainer region, the diameter at the position where the roller 341 abuts at the time when the cam 530 is rotated in a direction where the maximum lift amount increases, it is possible to yield the same effect as the effect (3) obtained in the above embodiment.

The variable valve device 100 is a device that changes the maximum lift amount VL of the intake valve 31 at three stages, but the number of stages to change the maximum lift amount VL can be modified appropriately. That is, the number of retainer regions in the cam surface of the cam 530 may be not less than four, or not more than two.

In the cam surface of the cam 530, the phase of the retainer region and the phase of the change region can be set freely. Further, respective inclination angles of the cam surface in a plurality of retainer regions can be set to the same magnitude. Particularly, in a case where a difference between magnitudes of respective axial forces of the control shaft 340 to act in respective retainer regions is small, even if an inclination angle is the same, a large difference does not occur in a magnitude of a torque to be caused. In view of this, respective inclination angles of the cam surface in the respective retainer regions may be set to the same magnitude.

As the actuator 200 for changing a rotational phase of the cam 530, an actuator including a motor such as a hydraulic motor, except the electrically-driven motor 210, can be employed. The variable valve device 100 is provided in a valve train system of the intake valve 31, but may be provided in a valve train system of the exhaust valve 41.

What is claimed is:

1. A variable valve device for an internal combustion engine, the variable valve device comprising:

a control shaft configured such that i) a maximum lift amount of an engine valve is determined according to a position of the control shaft in an axial direction and ii) an axial force acts on the control shaft due to a reaction force from a valve spring, the axial force being a force acting in the axial direction of the control shaft;

an action member attached to the control shaft;

a cam abutting with the action member, the cam being configured to displace the control shaft in the axial direction of the control shaft; and an actuator configured to pivot the cam by decelerating a rotation of a motor via a deceleration mechanism constituted by a plurality of gears in combination, the cam being provided with a change region and a retainer region, the change region being a region with which the action member abuts when the control shaft is displaced in the axial direction to change the maximum lift amount, and the change region being a region where a cam surface is inclined such that a diameter of the cam gradually increases toward one side in a rotation direction of the cam, the retainer region being a region with which the action member abuts when a position of the control shaft in the axial direction is retained to retain the maximum lift amount, and the retainer region being a region where the cam surface is inclined such that a torque is caused in the cam due to the axial force of the control shaft, the torque having a magnitude at which the gears constituting the deceleration mechanism are meshed with each other without being rotated.

2. The variable valve device according to claim 1, wherein in the retainer region, the cam surface is inclined such that the diameter gradually increases toward the one side in the rotation direction of the cam.

3. The variable valve device according to claim 1, wherein the cam includes a plurality of retainer regions in which respective maximum lift amounts to be retained are different from each other, and a plurality of change regions provided to connect the retainer regions to each other, the actuator selectively changes the maximum lift amounts by pivoting the cam to change the retainer regions with which the action member abuts, and an inclination angle of the cam surface in the retainer region is smaller as the maximum lift amount when the action member abuts with the retainer region is larger.

* * * * *